US005412118A

United States Patent [19]

Vermeer et al.

[11] Patent Number: 5,412,118

[45] Date of Patent: May 2, 1995

[54] THICKENED FOAM STABLE COMPOSITIONS COMPRISING ALKYL(ALKYL GLYCOSID)URONAMIDES

[75] Inventors: Robert Vermeer, Nutley; Bijan Harichian, South Orange, both of N.J.; Van Au, Peekskill, N.Y.

[73] Assignee: Lever Brothers Company, Division of Conopco, Inc., New York, N.Y.

[21] Appl. No.: 135,238

[22] Filed: Oct. 12, 1993

[51] Int. Cl.[6] ..... C11D 1/68

[52] U.S. Cl. ..... 549/417; 252/542; 252/548; 549/478

[58] Field of Search ..... 252/542, 548; 514/459, 514/471; 549/478

[56] References Cited

U.S. PATENT DOCUMENTS

| | | | |
|---|---|---|---|
| 3,260,714 | 7/1966 | Schroeder | 260/210 |
| 3,809,659 | 5/1974 | Gerecht | 252/542 |
| 4,483,779 | 11/1984 | Llenado et al. | 252/135 |

OTHER PUBLICATIONS

Fieser et al., Am. Chem. Soc., 78:2825 (1956).

*Primary Examiner*—Peter O'Sullivan
*Assistant Examiner*—Brian M. Burn
*Attorney, Agent, or Firm*—Ronald A. Koatz

[57] ABSTRACT

The present invention relates to liquid and powdered surfactant compositions comprising alkyl (alkyl glycosid) uronamide compounds. Compositions comprising these compounds have been found to provide significant benefits such as stable, aqueous foam (in shampoo compositions) and enhanced detergency and oily soil removal (in detergent compositions).

11 Claims, No Drawings

THICKENED FOAM STABLE COMPOSITIONS COMPRISING ALKYL(ALKYL GLYCOSID)URONAMIDES

FIELD OF INVENTION

This invention relates to liquid and powdered surfactant compositions comprising alkyl(alkyl glycosid-)uronamides.

In particular, hair shampoo compositions comprising alkyl(alkyl glycosid)uronamide were found to have an unexpectedly high level of stable and copious foam as well as an exceptionally high viscosity.

Also, powdered detergent compositions comprising alkyl(alkyl glycosid)uronamide were found to exhibit enhanced detergency and enhanced oily soil removal.

BACKGROUND OF THE INVENTION

The demand for liquid compositions in the area of detergents, personal products and cosmetics has been steadily rising. In fact, studies have shown that most individuals buy and use liquid compositions based on the quality and texture of foam generated, cleansing ability and tactile properties delivered. In addition, the viscosity of a liquid composition is important because consumers are accustomed to, and expect a composition to be thick and viscous. If a liquid composition is thin and nonviscous, a consumer may conclude that the product is inferior. Since most compositions are based on petrochemicals, it would be most desirable to use materials which are instead naturally derived, such as carbohydrates, to provide the desired attributes. These renewable raw materials have the distinct advantage of being readily available, inexpensive, biodegradable, aquatically favorable and optically pure.

It is known that methyl β-D-glucofuranosidurono-6,3-lactone can be reacted with amines to form the corresponding alkyl(methyl β-D-glucofuranosid) uronamides according to the following equation:

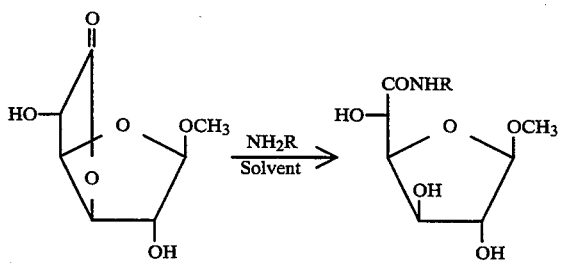

Fieser et al. in Am. Chem. Soc., 78:2825 (1956) teaches the described process where $R=C_{12}-C_{16}$ and makes reference to their poor water solubility and weak emulsifying properties. Since this reference teaches away from using these compounds as emulsifying surfactants, it was surprising to find that such compounds can be used as thickening or foam stabilizing agents for aqueous liquid surfactant systems.

As shown above, the references of the art not only fail to teach or suggest the use of alkyl(alkyl glycosid-)uronamides as viscosity modifiers and foam stabilizing agents but teach away. Specifically, they teach away from the use of such compounds in liquid or powdered surfactant compositions, particularly in shampoo and detergent compositions.

It is therefore, an object of the present invention to provide a use for alkyl(alkyl giycosid)uronamides as soluble surfactants or cosurfactants for both liquid and powdered compositions.

It is another object of the present invention to provide a use for alkyl(alkyl glycosid)uronamides as thickening and foam stabilizing agents for aqueous liquid surfactant compositions.

Another object of the present invention is to provide a shampoo composition comprising alkyl(alkyl glycosid)uronamide which demonstrates exceptional foaming and viscosity properties.

Yet another object of the present invention is to provide a powdered detergent composition comprising alkyl(alkyl glycosid)uronamide which demonstrates enhanced detergency and oily soil removal.

These and other objects of the invention will become more apparent from the detailed description and examples that follow.

SUMMARY OF THE INVENTION

This invention relates to liquid or powdered surfactant compositions comprising alkyl(alkyl glycosid-)uronamides derived from D-glucurono-6,3-lactone and D-galacturonic acid which function as effective surfactants or cosurfactants in powdered detergent composition or as thickening and foam stabilizing agents in liquid compositions. The surfactant thickener of the subject invention can be considered to be an improvement over the art known thickening agents. Specifically, shampoo compositions containing alkyl(alkyl glycosid)uronamide are shown to have enhanced viscosity relative to alkanolamide or ethoxylated alcohol thickening agents.

It has been found, in accordance with the present invention, that a shampoo composition comprising of alkyl(alkyl glycosid)uronamide unexpectedly generates a high level of stable and copious foam.

By contrast, compositions lacking alkyl(alkyl glycosid)uronamides exhibit low viscosity and unstable foam.

Also, it has been found in accordance with the present invention, that a powdered detergent composition comprising alkyl(alkyl glycosid)uronamide unexpectedly exhibits enhanced detergency and oily soil removal, particularly when used as a cosurfactant.

By contrast, compositions lacking alkyl(alkyl glycosid)uronamide exhibit poor detergency and oily soil removal.

DETAILED DESCRIPTION OF THE INVENTION

The present invention relates to compositions comprising a class of environmentally friendly, "green" nonionic glycolipid surfactants. In particular, the invention relates to shampoo and powdered detergent compositions comprising alkyl(alkyl glycosid)uronamides derived from D-glucurono-6,3-lactone or D-galacturonic acid which function as effective surfactants or cosurfactants in powdered detergent compositions or as thickening and foam stabilizing agents in liquid compositions.

In general, the alkyl(alkyl glycosid)uronamides used in these compositions are defined as amides of uronic acid glycosides, uronolactone glycosides or uronate ester glycosides of the following general formula:

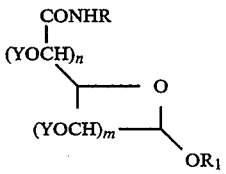

wherein:

$n=0-2$ $m=2-4$

Y is a hydrogen, mono-, oligo- or polysaccharide; uronic acid, uronic acid salt, uronic acid lactone or polyuronic acid; and R is a $C_1$ to $C_{24}$, straight or branched chain alkyl or alkenyl group which may contain an aromatic, cycloaliphatic or polyalkyloxyalkyl radical.

$R_1$ is a hydrogen, or a $C_1$ to $C_{24}$ straight or branched chain alkyl or alkenyl group which may contain an aromatic, cycloaliphatic or polyalkyloxyalkyl radical.

Suitable mono-, oligo- or polysaccharides that may be used to form alkyl(alkyl glycosid)uronamides of the invention include, but are not limited to glucose, galactose, mannose, gulose, sucrose, lactose, fructose, sorbitol, maltose and starch.

Examples of polyuronic acids, uronic acids or their lactones of the invention include, but are not limited to D-glucurono-6,3-lactone, D-galacturonic acid, D-glucuronic acid, D-mannuronic acid, L-guluronic acid, L-lyxuronic acid, L-lduronic acid, pectin, algin, alginic acid, oxidized starch, oxidized cellulose and acacia.

Suitable aliphatic hydrocarbon radicals include saturated and unsaturated radicals including but not limited to methyl, ethyl, propyl, butyl, hexyl, nonyl, decyl, undecyl, dodecyl, tridecyl, tetradecyl, pentadecyl, hexadecyl, heptadecyl and octadecyl; allyl, decenyl, dodecenyl, tetradecenyl, oleyl, iinoleyl and linolenyl. The active compounds of the invention may contain straight or branched aliphatic groups. Aromatic radicals are exemplified by benzyl, aniline or substituted benzyl or aniline groups. Suitable mixed aliphatic aromatic groups are exemplified by benzylpropyl, phenylethyl, phenoxyethyl and vinylbenzyl. Cycloaliphatic radicals are exemplified but not limited to cyclopentyl and cyclohexyl. Suitable polyalkyloxyalkyl radicals include, dodecyloxyethyl, tetradecyloxypropyl, dodecyloxypropylene, dodecyl(trioxyethyl), dodecyl (pentaoxypropyl), tetradecyl(tetraoxypropylene) and tetradecyl(nonyloxyethyl). The alkyl(alkyl glycoside)uronamides of the invention may also be ethoxylated, propoxylated or a mixture of both.

The chemical behavior of alkyl(alkyl glycosid)uronamides prepared by the process of the invention results in the formation of pyranosides, furanosides or preferably both.

In a preferred embodiment of the invention, a suitable alkyl(alkyl glycosid)uronamide that may be used as thickening and foam stabilizing agent in aqueous liquid surfactant compositions or as surfactants or cosurfactants in powdered detergent compositions are set forth below:

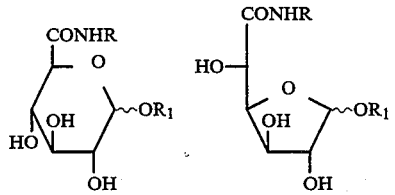

alkyl(alkyl D-glucosid)uronamides;

or

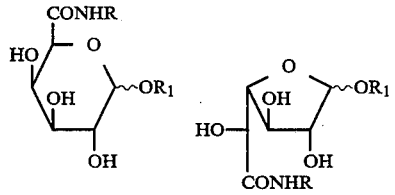

alkyl(alkyl D-galactosid)uronamides wherein, in each case, R and $R_1$ is a substituted or unsubstituted, saturated or unsaturated alkyl group having 1 or more carbons, preferably $R_1$ has 1 to 3 carbons or hydrogen and R has 8–18 carbons.

It is well known that uronic acids and their lactones undergo many transformations when reacted with alcohols under acidic conditions. The major reactions which are thought to take place for D-glucurono-6,3-lactone and D-galacturonic acid are set forth below:

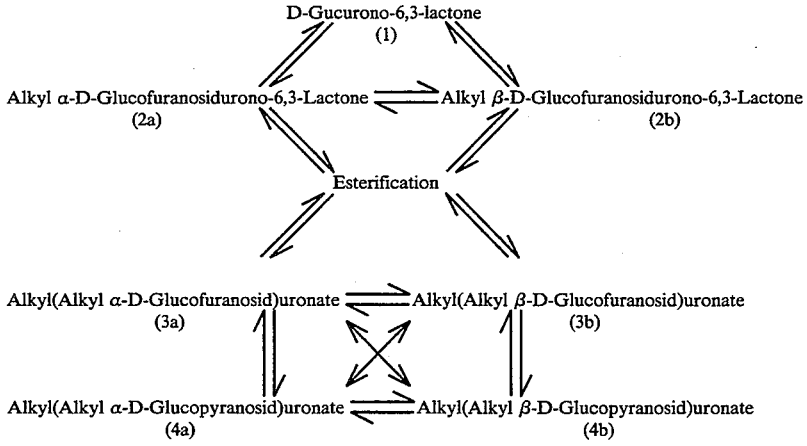

-continued

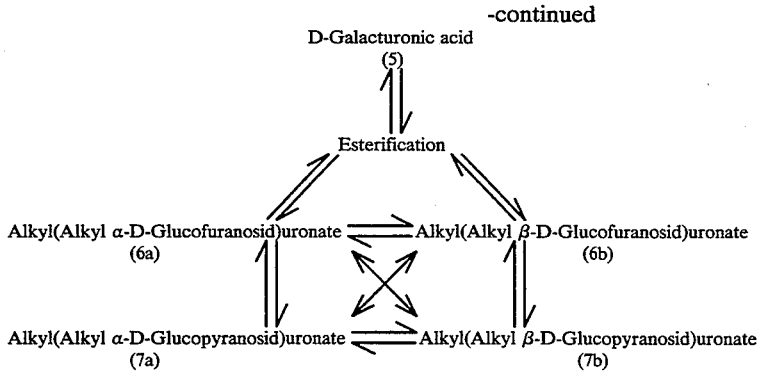

From the above schemes, it can be seen that with uronic acids (or their lactones), glycosidation and esterification are competing reactions resulting in a mixture of anomers (*2a–7b*). In the case of D-glucurono-6,3-lactone, glycosidation is more rapid than esterification, whereas the reverse holds true for D-galacturonic acid, esterification is more rapid than glycosidation.

The invention can be more readily understood when reference is made to the general equation:

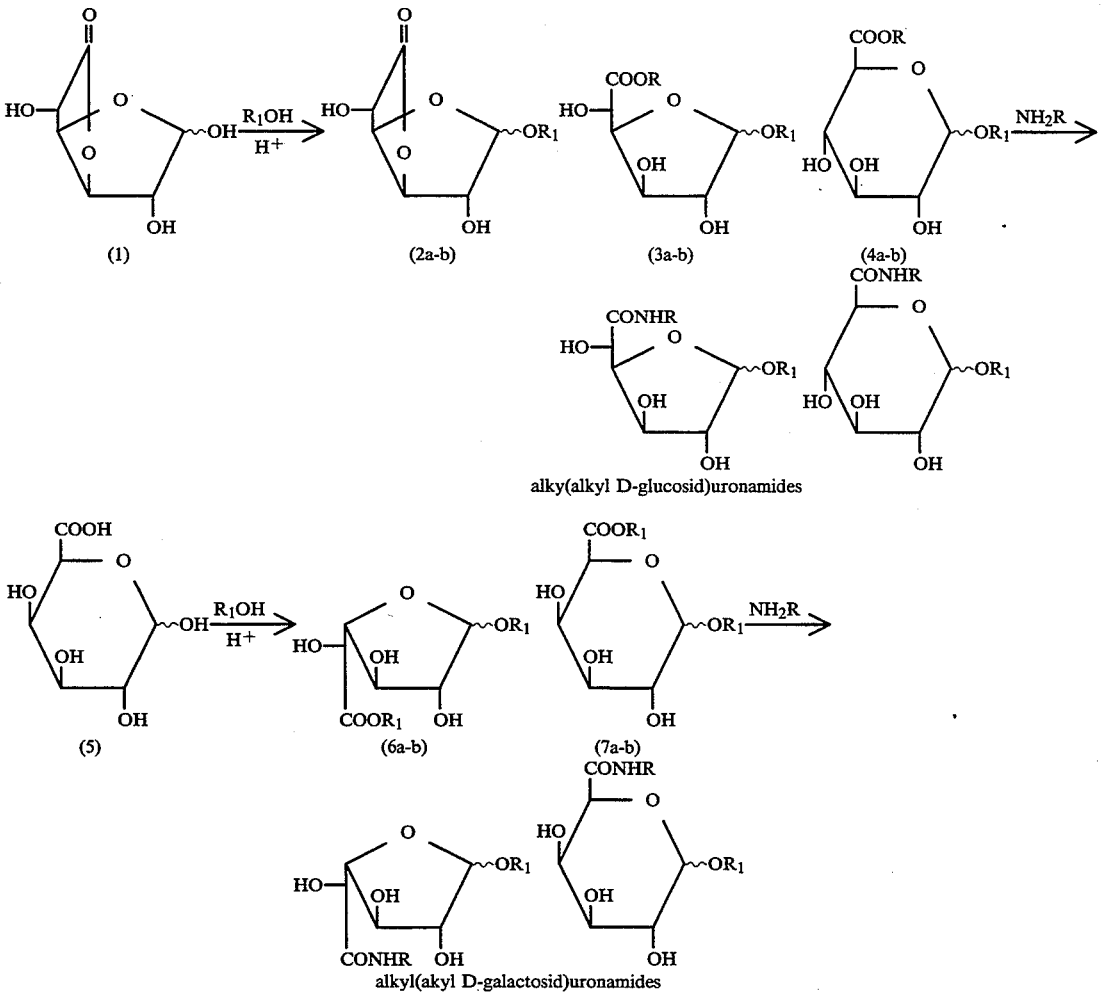

When used in liquid compositions, the glycolipids of the invention are especially suitable as thickening and foam stabilizing agents where $R_1$ is an alkyl group having about 1 to 8 carbons, preferably 1 to 3 carbons or hydrogen and R is also an alkyl group having about 6 to 24 carbons, preferably 8 to 18 carbons.

While not wishing to be bound to theory, it is believed that common thickeners and foam stabilizers such as lauramide diethanolamine (DEA) and cocoamide monoethanolamine (MEA) operate by being solubilized in the palisade layer of an ionic micelle. Here they act as "buffers" between repelling ionic head groups producing a closer-packed coherent surface film of foam that is more resilient and slow draining.

The efficiency of an additive to stabilize foam and enhance viscosity increases with the number of hydrogen bonding groups per molecule as well as with the length of the hydrocarbon chain. Additive hydrogen bonding groups are attracted to the ionic head groups of the surfactant by ion-dipole interactions whereas the hydrocarbon portions are attracted by van der Waals forces. Therefore, the greater the intermolecular cohesive forces, the more effectively the additive is held in the palisade layer. Since long chained alkyl(alkyl glycosid)uronamides contain multiple hydrogen bonding groups, they should be held tightly in the palisade layer and should not be squeezed out or forced into the interior of the micelle. If the alkyl(alkyl glycosid)uronamide is of proper size, a composition should exhibit enhanced stable foam and increased viscosity.

The uronamides of the invention may be used, for example, in bar or body shampoos. Examples of such compositions are described in U.S. Pat. No. 4,854,333, to Inman and U.S. Pat. No. 4,526,710 to Fujisawa, both of which are hereby incorporated by reference.

The shampoo compositions which may be used typically comprise a surfactant selected from any one of a wide variety of surfactants known in the art (such as those described in U.S. Pat. No. 4,854,333, incorporated herein by reference). The shampoo compositions may additionally comprise a compound considered useful for treating dandruff, e.g., selenium sulfide.

The compositions all may also optionally comprise a suspending agent, for example, any of several acyl derivative materials or mixtures thereof. Among these are ethylene glycol esters of fatty acids having 16 to 22 carbons. Preferred suspending agents include ethylene glycol stearates, both mono- and distearate. Preferred alkanol amides are stearic monoethanolamide, stearic diethanolamide and stearic monoisopropanolamide. Still other long chain acyl derivatives include long chain esters of long chain fatty acids (e.g., stearyl stearate, cetyl palmitate), glyceryl esters (e.g., glyceryl distearate), and long chain esters of long chain alkanol amides (e.g., stearamide DEA distearate, stearamide MEA stearate).

Still other suitable suspending agents are alkyl (16 to 22 carbon) dimethyl amine oxides, such as stearyl dimethyl amine oxide. If the compositions contain an amine oxide or a long chain acyl derivative as a surfactant, these components may also provide the suspending function and additional suspending agent may not be needed.

Xanthan gum is another agent used to suspend, for example, selenium sulfide which may be in the present compositions. This biosynthetic gum material is commercially available and is a heteropolysaccharide with a molecular weight of greater than 1 million. It is believed to contain D-glucose, D-mannose and D-glucuronate in the molar ratio of 2.8:2.0:2.0. The polysaccharide is partially acetylated with 4.7% acetyl. Supplemental information on these agents is found in Whistler, Roy L. (Editor), Industrial Gums- Polysaccharides and Their Derivatives New York: Academic Press, 1973. Kelco, a Division of Merck & Co., Inc., offers xanthan gum as Keltrol®.

A particularly preferred suspending system comprises a mixture of xanthan gum, present at a level of from about 0.05% to about 1.0%, preferably from about 0.2% to about 0.4%, of the compositions, together with magnesium aluminum silicate ($Al_2Mg_8Si_2$), present at a level of from about 0.1% to about 3.0%, preferably from about 0.5% to about 2.0%, of the compositions. Magnesium aluminum silicate occurs naturally in such smectite minerals as colerainite, saponite and sapphire. Refined magnesium aluminum silicates useful herein are readily available, for example as veegum, manufactured by R. T. Vanderbilt Company, Inc. Mixtures of suspending agents are also suitable for use in the compositions of this invention.

Other useful thickening agents are the cross-linked polyacrylates such as those manufactured by B. F. Goodrich and sold under the Carbopol® tradename.

Another optional component for use in the present compositions is an amide. The amide used in the present compositions can be any of the alkanolamides of fatty acids known for use in shampoos. These are generally mono- and diethanolamides of fatty acids having from about 8 to 24 carbon atoms. Preferred are coconut monoethanolamide, lauric diethanolamide and mixtures thereof. The amide is present at a level of from about 1% to about 10% of the compositions.

The compositions may also contain nonionic polymer material which is used at a low level to aid in dispersing particles. The material can be any of a large variety of types including cellulosic materials such as hydroxypropyl methyl cellulose, carboxymethyl cellulose, hydroxyethyl cellulose and sodium carboxymethyl cellulose as well as mixtures of these materials. Other materials include alginates, polyacrylic acids, polyethylene glycol and starches, among many others. The nonionic polymers are discussed in detail in *Industrial Gums,* edited by Roy L. Whistler, academic Press, Inc., 1973, and *Handbook of Water-Soluble Gums and Resins,* edited by Robert L. Davidson, McGraw-Hill, Inc., 1980. Both of these books in their entirety are incorporated herein by reference.

When included, the nonionic polymer is used at a level of from about 0.001% to about 0.1%, preferably from about 0.002% to about 0.05%, of the composition. Hydroxypropyl methyl cellulose is the preferred polymer.

Another suitable optional component useful in the present compositions is a nonvolatile silicone fluid.

The nonvolatile silicone fluid may be either a polyalkyl siloxane, a polyaryl siloxane, a polyalkylarly siloxane or a polyether siloxane copolymer and is present at a level of from about 0.1% to about 10.0%, preferably from about 0.5% to about 5.0%. Mixtures of these fluids may also be used and are preferred in certain executions. The dispersed silicone particles should also be insoluble in the shampoo matrix. This is the meaning of "insoluble" as used herein.

The essentially nonvolatile polyalkyl siloxane fluids that may be used include, for example, polydimethyl siloxanes with viscosities ranging from about 5 to about 600,000 centistokes at 25° C. These siloxanes are available, for example, from the General Electric Company as the Viscasil series and from Dow Corning as the Dow Corning 200 series. The siloxane viscosity can be measured by means of a glass capillary viscometer as set forth in Dow Corning Corporate Test Method CTM0004, Jul. 20, 1970. Preferably the viscosity of the these siloxanes range from about 350 centistokes to about 100,000 centistokes.

The essentially nonvolatile polyether siloxane copolymer that may be used is, for example, a polypropylene oxide modified dimethylpolysiloxane (e.g., Dow Corning DC-1248), although ethylene oxide or mixtures of ethylene oxide and propylene oxide may also be used.

Suitable silicone fluids are described in U.S. Pat. No. 2,826,551, Geen; U.S. Pat. No. 3,946,500, Jun. 22, 1976, Drakoff; U.S. Pat. No. 4,364,837, Pader; and British Patent 849,433, Woolston. All of these patents are incorporated herein by reference, also incorporated herein by reference is Silicon Compounds, distributed by Petrarch Systems, Inc., 1984. This reference provides a very good listing of suitable silicone materials.

Another silicone material useful is silicone gum. Silicone gums are described by Petrarch and others including U.S. Pat. No. 4, 152,416, May 1, 1979, Spitzer, et al., and Noll, *Chemistry and Technology of Silicones,* New York, Academic Press, 1968. Useful silicone gums are also described in General Electric Silicone Rubber Product Data Sheets SE 30, SE 33, SE 54 and SE 76. all of these references are incorporated herein by reference. "Silicone gum" materials denote high molecular weight polydiorganosiloxanes having a mass molecular weight of from about 200,000 to about 1,000,000. Specific examples include polydimethylsiloxane, (polydimethylsiloxane) (methylvinylsiloxane) copolymer, poly(dimethylsiloxane) (diphenyl) (methylvinylsiloxane) copolymer, and mixtures thereof. Mixtures of silicone fluids and silicone gums are also useful herein.

The shampoos herein can contain a variety of other nonessential optional components suitable for rendering such compositions more formulatable, or aesthetically and/or cosmetically acceptable. Such conventional optional ingredients are well-known to those skilled in the art and include, e.g., preservatives, such as benzyl alcohol, methyl paraben, propyl paraben, and imidazolinidyl urea; cationic surfactants, such as cetyl trimethyl ammonium chloride, lauryl trimethyl ammonium chloride, tricetyl methyl ammonium chloride, stearyldimethyl benzyl ammonium chloride, and di(partially hydrogenated tallow) dimethylammonium chloride; menthol; thickeners and viscosity modifiers, such as block polymers of ethylene oxide and propylene oxide such as Pluronic F88 offered by BaSa Wyandotte, sodium chloride, sodium sulfate, propylene glycol, and ethyl alcohol; pH adjusting agents, such as citric acid, succinic acid, phosphoric acid, sodium hydroxide, sodium carbonate; perfumes; dyes; and sequestering agents, such as disodium ethylenediamine tetraacetate. Such agents generally are used individually at a level of from about 0.01% to about 10%, preferably from about 0.5% to about 5.0%, of the composition.

In order to demonstrate the effectiveness of alkyl(alkyl glycosid)uronamides as foam stabilizing agents and viscosity modifiers, one prototype shampoo composition was prepared comprising glycolipid, and another was prepared comprising alkanolamide or alcohol ethoxylate. Surprisingly, the prototype composition comprising of alkyl(alkyl glycosid)uronamide unexpectedly showed exceptionally stable and copious foam as well as enhanced viscosity relative to other prototype compositions.

In addition, the alkyl(alkyl glycosid)uronamides of the invention are well suited as effective surfactants, preferably as cosurfactants in powdered or liquid detergent compositions.

Overall detergency is even further enhanced when the compound is used as a cosurfactant. When used as a cosurfactant, the compound is generally used in an amount ranging from about 1% to 80% of total surfactant, preferably 5% to 70% of total surfactant and most preferably at 7.5% to 60% total surfactant.

Examples of liquid detergent compositions are described in U.S. Pat. No. 4,959, 179 to Aronson et al. hereby incorporated by reference into the subject application; and examples of powdered detergent compositions are described in U.S. Pat. No. 4,929,379 to Oldenburg et al. hereby incorporated by reference into the subject application.

The liquid detergent compositions of the invention may be built or unbuilt and may be aqueous or nonaqueous. The compositions generally comprise about 5% to 70% by weight of a detergent active material and from 0% to 50% of a builder. The liquid detergent compositions of the invention may further comprise an amount of electrolyte (defined as any water-soluble salt) whose quantity depends on whether or not the composition is structured. By structured is meant the formation of a lamellar phase sufficient to endow solid suspending capability.

More particularly, while no electrolyte is required for a non-structured, non-suspending composition, at least 1%, more preferably at least 5% by weight and most preferably at least 15% by weight electrolyte is used. The formation of a lamellar phase can be detected by means well known to those skilled in the art.

The water-soluble electrolyte salt may be a detergency builder, such as the inorganic salt sodium tripolyphosphate or it may be a non-functional electrolyte such as sodium sulphate or chloride. Preferably, whatever builder is used in the composition comprises all or part of the electrolyte.

The liquid detergent composition generally further comprises enzymes such as proteases, lipases, amylases and cellulases which, when present, may be used in amounts from about 0.01 to 5% of the compositions. Stabilizers or stabilizer systems may be used in conjunction with enzymes and generally comprise from about 0.1 to 15% by weight of the composition.

The enzyme stabilization system may comprise calcium ion, boric acid, propylene glycol and/or short chain carboxylic acids. The composition preferably contains from about 0.01 to about 50, preferably from about 0.1 to about 30, more preferably from about 1 to about 20 millimoles of calcium ion per liter.

When calcium ion is used, the level of calcium ion should be selected so that there is always some minimum level available for the enzyme after allowing for complexation with builders, etc., in the composition. Any water-soluble calcium salt can be used as the source of calcium ion, including calcium chloride, calcium formate, calcium acetate and calcium propionate. A small amount of calcium ion, generally from about 0.05 to about 2.5 millimoles per liter, is often also present in the composition due to calcium in the enzyme slurry and formula water.

Another enzyme stabilizer which may be used is propionic acid or a propionic acid salt capable of forming propionic acid. When used, this stabilizer may be used in an amount from about 0.1% to about 15% by weight of the composition.

Another preferred enzyme stabilizer is polyols containing only carbon, hydrogen and oxygen atoms. They preferably contain from 2 to 6 carbon atoms and from 2 to 6 hydroxy groups. Examples include propylene glycol (especially 1,2 propanediol which is preferred), ethylene glycol, glycerol, sorbitol, mannitol and glucose. The polyol generally represents from about 0.5% to about 15%, preferably from about 1.0% to about 8% by weight of the composition.

The composition herein may also optionally contain from about 0.25% to about 5%, most preferably from about 0.5% to about 3% by weight of boric acid. The boric acid may be, but is preferably not, formed by a compound capable of forming boric acid in the composition. Boric acid is preferred, although other compounds such as boric oxide, borax and other alkali metal borates (e.g., sodium ortho-, meta- and pyroborate and sodium pentaborate) are suitable. Substituted boric acids (e.g., phenylboronic acid, butane boronic acid and a p-bromo phenylboronic acid) can also be used in place of boric acid.

One especially preferred stabilization system is a polyol in combination with boric acid. Preferably, the weight ratio of polyol to boric acid added is at least 1, more preferably at least about 1.3.

With regard to the detergent active, the detergent active material may be an alkali metal or alkanolamine soap or a 10 to 24 carbon atom fatty acid, including polymerized fatty acids, or an anionic, a nonionic, cationic, zwitterionic or amphoteric synthetic detergent material, or mixtures of any of these.

Examples of the anionic synthetic detergents are salts (including sodium, potassium, ammonium and substituted ammonium salts) such as mono-, di- and triethanolamine salts of 9 to 20 carbon alkylbenzenesulphonates, 8 to 22 carbon primary or secondary alkanesulphonates, 8 to 24 carbon olefinsulphonates, sulphonated polycarboxylic acids prepared by sulphonation of the pyrolyzed product of alkaline earth metal citrates, e.g., as described in British Patent specification, 1,082,179, 8 to 22 carbon alkylsulphates, 8 to 24 carbon alkylpolyglycol-ether- sulphates,-carboxylates and-phosphates (containing up to 10 moles of ethylene oxide); further examples are described in "Surface Active Agents and Detergents" (vol. I and II) by Schwartz, Ferry and Bergh. Any suitable anionic may be used and the examples are not intended to be limiting in any way.

Examples of nonionic synthetic detergents which may be used with the invention are the condensation products of ethylene oxide, propylene oxide and/or battalion oxide with 8 to 18 carbon alkylphenols, 8 to 18 carbon fatty acid amides; further examples of nonionics include tertiary amine oxides with 8 to 18 carbon alkyl chain and two 1 to 3 carbon alkyl chains. The above reference also describes further examples of nonionics.

The average number of moles of ethylene oxide and/or propylene oxide present in the above nonionics varies from 1 to 30; mixtures of various nonionics, including mixtures of nonionics with a lower and a higher degree of alkoxylation, may also be used.

Examples of cationic detergents which may be used are the quaternary ammonium compounds such as alkyldimethylammonium halogenides.

Examples of amphoteric or zwitterionic detergents which may be used with the invention are N-alkylamine acids, sulphobetaines, condensation products of fatty acids with protein hydrolysates; but owing to their relatively high costs they are usually used in combination with an anionic or a nonionic detergent. Mixtures of the various types of active detergents may also be used, and preference is given to mixtures of an anionic and a nonionic detergent active. Soaps (in the form of their sodium, potassium and substituted ammonium salts) of fatty acids may also be used, preferably in conjunction with an anionic and/or nonionic synthetic detergent.

Builders which can be used according to this invention include conventional alkaline detergency builders, inorganic or organic, which can be used at levels from 0% to about 50% by weight of the composition, preferably from 1% to about 20% by weight, most preferably from 2% to about 8%.

Examples of suitable inorganic alkaline detergency builders are water-soluble alkalimetal phosphates, polyphosphate, borates, silicates and also carbonates. Specific examples of such salts are sodium and potassium triphosphates, pyrophosphates, orthophosphates, hexametaphosphates, tetraborates, silicates and carbonates.

Examples of suitable organic alkaline detergency builder salts are: (1) water-soluble amino polycarboxylates, e.g., sodium and potassium ethylenediaminetetraacetates, nitrilotriacetates and N-(2 hydroxyethyl)-nitrilo diacetates; (2) water-soluble salts of phytic acid, e.g., sodium and potassium phytates (see U.S. Pat. No. 2,379,942); (3) water-soluble polyphosphonates, including specifically, sodium, potassium and lithium salts of ethane-1-hydroxy-1,1diphosphonic acid; sodium, potassium and lithium salts of methylene diphosphonic acid; and sodium, potassium and lithium salts of ethane-1,1,2-triphosphonic acid. Other examples include the alkali methal salts of ethane-2-carboxy-1,1-diphosphonic acid hydroxymethanediphosphonic acid, carboxylidiphosphonic acid, ethane-1 -hydroxy- 1,1,2-triphosphonic acid, ethane-2-hydroxy-1,1,2-triphosphonic acid, propane-1,1,3,3-tetraphosphonic acid, propane-1,1,2,3-tetraphosphonic acid, and propane-1,2,2,3-tetraphosphonic acid; (4) water soluble salts of polycarboxylate polymers and copolymers as described in U.S. Pat. No. 3,308,067.

In addition, polycarboxylate builders can be used satisfactorily, including water-soluble salts of mettitic acid, citric acid, and carboxymethyloxysuccinic acid and salts of polymers of itaconic acid and maleic acid. Other polycarboxylate builders include DPA (dipicolinic acid) and ODS (oxydisoccinic acid). Certain zeolites or aluminosilicates can be used. One such aluminosilicate which is useful in the compositions of the invention is an amorphous water-insoluble hydrated compound of the formula $Na_x(_yAlO_2.SiO_2)$, wherein x is a number from 1.0 to 1.2 and y is 1, said amorphous material being further characterized by a $Mg++$exchange capacity of from about 50mg eq. $CaCO_3$/g. and a particle diameter of from about 0.01 micron to about 5 microns. This ion exchange builder is more fully described in British Pat. No. 1,470,250.

A second water-insoluble synthetic aluminosilicate ion exchange material useful herein is crystalline in nature and has the formula $Na_{2[(AlO2)_y.(SiO_2)]}xH_2O$, wherein z and y are integers of at least 6; the molar ratio of z and y is in the range from 1.0 to about 0.5, and x is an integer from about 15 to about 264; said aluminosilicate ion exchange material having a particle size diameter from about 0.1 micron to about 100 microns; a calcium ion exchange capacity on an anhydrous basis of at least about 200 milligrams equivalent of $CaCO_3$ hardness per gram; and a calcium exchange rate on an anhydrous basis of at least about 2 grams/gallon/minute/gram. These synthetic aluminosilicates are more fully described in British Pat. No. 1,429,143.

In addition to the ingredients described hereinbefore, the preferred compositions herein frequently contain a series of optional ingredients which are used for the known functionality in conventional levels. While the detergent compositions are generally premised on aqueous, enzyme-containing detergent compositions, it is frequently desirable to use a phase regulant. This component together with water constitutes then the solvent matrix for the claimed liquid compositions. Suitable phase regulants are well-known in liquid detergent technology and, for example, can be represented by hydrotropes such as salts of alkylarylsulfonates having up to 3 carbon atoms in the alkylgroup, e.g., sodium, potassium, ammonium and ethanolamine salts of xylene-, toluene-, ethylbenzene-, cumene-, and isopropylbenzene sulfonic acids. Alcohols may also be used as phase regulants. This phase regulant is frequently used in an amount from about 0.5% to about 20%, the sum of phase regulant and water is normally in the range from 35% to 65%.

The preferred compositions herein can contain a series of further optional ingredients which are mostly used in additive levels, usually below about 5%. Examples of the like additives include: polyacids, suds regulants, opacifiers, antioxidants, bactericides, dyes, perfumes, brighteners and the like.

The beneficial utilization of the claimed compositions under various usage conditions can require the utilization of a suds regulant. While generally all detergent suds regulants can be utilized, preferred for use herein are alkylated polysiloxanes such as dimethylpolysiloxane, also frequently termed silicones. The silicones are frequently used in a level not exceeding 0.5%, most preferably between 0.01% and 0.2%.

It can also be desirable to utilize opacifiers inasmuch as they contribute to create a uniform appearance of the concentrated liquid detergent compositions. Examples of suitable opacifiers include: polystyrene commercially known as LYTRON 621 manufactured by Monsanto Chemical Corporation. The opacifiers are frequently used in an amount from 0.3% to 1.5%.

The compositions herein can also contain known antioxidants for their known utility, frequently radical scavengers in the art established levels, i.e., 0.00.1% to 0.25% (by reference to total composition). These antioxidants are frequently introduced in conjunction with fatty acids.

The liquid detergent compositions of the invention may also contain deflocculating polymers such as described in U.S. Ser. No. 664,513 to Kaiserman et al. filed Mar. 5, 1991 (now U.S. Pat. No. 5,071,586) hereby incorporated by reference.

When the liquid composition is an aqueous composition, the balance of the formulation consists of an aqueous medium. When it is in the form of a nonaqueous composition, the above ingredients make up for the whole formulation (a nonaqueous composition may contain up to 5% water).

An ideal liquid detergent composition might contain (all percentages by weight):

(1) 5–70% detergent active;
(2) 0–50% builder;
(3) 0–40% electrolyte
(4) 0.01–5% enzyme;
(5) 0.1–15% enzyme stabilizer;
(6) 0–20% phase regulant; and
(7) remainder water and minors The detergent composition of the invention might also be a powdered detergent composition.

Such powdered compositions generally comprise from about 5–40% of a detergent active system which generally consists of an anionic, a nonionic active, a fatty acid soap or mixtures thereof; from 20–70% of an alkaline buffering agent; up to about 40% builder and balance minors and water.

The alkaline buffering agent may be any such agent capable of providing a 1% product solution with a pH of above 11.5 or even 12. Advantageous alkaline buffering agents are the alkalimetal silicates, as they decrease the corrosion of metal parts in washing machines, and in particular sodium orthometaor ˉdi-silicates, of which sodium metasilicate is preferred. The alkaline buffering agent is present in an amount of from 0 to 70% by weight, preferably from 0 to 30% by weight.

In addition the compositions of the invention can and normally will contain detergency builders in an amount of up to 40% by weight and preferably from 5 to 25% by weight of the total composition.

Suitable builders include sodium, potassium and ammonium or substituted ammonium pyro- and tri-polyphosphates, -ethylene diamine tetraacetates, -nitrilotriacetates, -etherpolycarboxylates, -citrates, -carbonates, -orthophosphates, -carboxymethyloxysuccinates, etc. Other builders include DPA and ODS. Also less soluble builders may be included, such as e.g., an easily dispersible zeolite. Particularly preferred are the polyphosphate builder salts, nitrilotriacetates, citrates, carboxymethyloxysuccinates and mixtures thereof.

Other conventional materials may be present in minor amounts, provided they exhibit a good dissolving or dispersing behavior; for example sequestering agents, such as ethylenediamine tetraphosphonic acid; soil-suspending agents, such as sodiumcarboxymethylcellulose, polyvinylpyrrolidone or the maleic anhydride/vinylmethylether copolymer, hydrotropes; dyes; perfumes; optical brighteners; alkali-stable enzymes; germicides; anti-tarnishing agents; lather depressants; fabric softening agents; oxygen- or chlorineliberating bleaches, such as dichlorocyanuric acid salts or alkalimetal hypochlorides.

The remainder of the composition is water, which is preferably present in hydrated form, such as e.g., in the form of silicate 5 aq.

An ideal powdered detergent composition might contain the following (all percentages by weight):

(1) 5–40% detergent active;
(2) 0–40% builder;
(3) 0–30% buffer salt;
(4) 0–30% sulfate;
(5) 0–20% bleach system;
(6) 0–4% enzyme; and
(7) Minors plus water to 100%

It should further be understood that the compounds of the invention may be used as cosurfactants in combination with one or more other actives selected from those described above. In a preferred embodiment of the invention, the powdered system may comprise the compound of the invention in combination with both anionic and nonionic surfactants.

The compounds of the invention may be used in the area of detergents, personal products, dental and cosmetics. In particular, they are useful in shampoos, conditioners, liquid hand soaps, light or heavy duty liquid detergents, shower gels, bubble baths, lotions, mouthwashes or dentifrices.

In order to more fully illustrate the nature of the invention and the manner of practicing the same, the following examples are presented. The examples are for illustrative purposes only and are not intended to limit the invention in any way.

EXAMPLE 1

Preparation of Methyl β-D-Glucofuranosidurono-6.3-Lactone (MβGlucl)

D-Glucurono-6,3-lactone (100.0 g, 0.57 mole), anhydrous methanol (200.0 g, 6.24 moles), and methanesulfonic acid (3 drops) were placed in an oven dried three-necked round bottom flask equipped with mechanical stirrer, thermometer and condenser. The mixture was heated for 24 hours at reflux, cooled and neutralized with 0.1N methanolic KOH. The mixture was filtered and washed with cold methanol (20 ml) yielding 20.9g of methyl β-D-glucofuranosidurono-6, 3-lactone (MβGlucl). By further concentration of the filtrate an additional 28.2 g of MβGlucl was isolated giving a total yield of 49.1 g (45.3%), MP=139, % Purity=99.1.

EXAMPLE 2

Preparation of Dodecyl(Methyl β-D-Glucofuranosid)uronamide

Methyl β-D-glucofuranosidurono-6,3-lactone (20.0 g, 0.11 mole), anhydrous methanol (20 ml), and anhydrous acetonitrile (50 ml) were placed in a three-necked round bottom flask equipped with a mechanical stirrer, thermometer and condenser. The mixture was heated to 40° C. and N-dodecylamine (19.5 g, 0.11 mole) dissolved in anhydrous acetonitrile (10 ml) added dropwise. The solution was allowed to stand overnight at room temperature, filtered, and washed with acetonitrile (2×25 ml) giving a yield of 24.7 g (77.3%), MP=90°-91° C., % Purity=99.3.

EXAMPLE 3

Preparation of Tetradecyl(Methyl β-D-Glucofuranosid)uronamide

Prepared as in Example 2 except N-tetradecylamine (23.5g, 0.11 mole) was used. The yield was 37.8 g (87.0%), % Purity=98.5.

EXAMPLE 4

Preparation of Methyl(Methyl D-Glucosid)uronate

D-Glucurono-6,3-lactone (25.0 g, 0.14 mole), anhydrous methanol (225 ml, 5.55 moles) and p-toluenesulfonic acid (2.14 g, 0.011 mole) were placed in a three-necked round bottom flask equipped with a mechanical stirrer, thermometer and condensor. The mixture was heated for 24 hours at reflux, cooled and neutralized with methanolic KOH. A sample was taken and analyzed and found to contain a mixture of methyl β-D-glucofuranosidurono-6,3-lactone, methyl(methyl α-D-glucopyranosid)uronate and methyl(methyl β-D-glucopyranosid) uronate.

EXAMPLE 5

Preparation of Dodecyl(Methyl D-Glucosid)uronamide

Dodecylamine (26.0 g, 0.14 mole) was added to an anomeric mixture of methyl(methyl D-glucosid)uronate in methanol (from Example 4) and heated to 55° C. for eight hours. Methanol was removed (125 ml) and the product allowed to stand overnight at room temperature to allow complete crystallization. The product was filtered and washed with cold acetone (3×40ml) giving a yield of 51.1 g (97.0%).

EXAMPLE 6

Preparation of Methyl(Methyl α-D-Galactopyranosid)uronate

D-Galacturonic acid monohydrate (97%, 25.0 g, 0.12 mole) and 0.1N methanolic HCl(300 ml, 7.41 moles) were placed in a three-necked round bottom flask equipped with a mechanical stirrer, thermometer, and condenser. The mixture was heated for 24 hours at reflux, cooled and neutralized with 1N methanolic KOH. Excess methanol was removed and ethanol (75 ml) added. The solution was cooled to 0° C., potassium chloride filtered and washed with cold ethanol (20 ml). The filtrate was concentrated to about 40 ml, heated to 40° C. and enough ether added to make the solution turbid. After standing at room temperature overnight, 6.5 g of methyl (methyl α-D-galactopyranosid)uronate was isolated and washed with cold ethanol/ether solution (20 ml). By further concentration of the filtrate, an additional 1.0 g of product was isolated, giving a total yield of 7.5 g (28.7%). MP=139-140; % Purity 98.2.

EXAMPLE 7

Preparation of Decyl(Methyl α-D-Galactopyranosid)uronamide

Methyl(methyl α-D-galactopyranosid)uronate (2.0 g, 0.009 mole), anhydrous methanol (15 ml) and N-decylamine (4.25 g, 0.027 mole) were placed in a three-necked round bottom flask equipped with a mechanical stirrer, thermometer and short path distillation head. The mixture was heated for ½ hour at reflux. The methanol was removed, heptane (35 ml) added and stirred rapidly. The product was filtered, washed with heptane (3×20 ml) and dried giving 2.3 g (73.6%). One recrystallization from aqueous ethanol yielded 1.8 g (57.5%) of pure product. MP=180-181; % Purity=99.3.

EXAMPLES 8-12

Evaluation of Dodecyl(Methyl β-D-Glucofuranosid-)uronamide (DoMβGlucf)amide

In order to determine the effectiveness of alkyl(alkyl glycosid)uronamides as viscosity modifiers and foam stabilizing agents, a prototype shampoo composition was prepared comprising of glycolipid and compared to one comprising alkanolamide or alcohol ethoxylate. In particular, Example 8 illustrates alkyl(alkyl glycosid-)uronamide solubility with sodium dodecyl sulfate (SDS). Examples 9 and 10 illustrate alkyl(alkyl glycosid)uronamides improved ability to generate a copious stable foam and enhance viscosity. Example 11 illustrates alkyl(alkyl glycosid)uronamide ability to reduce irritation potential and deliver mildness. Lastly, Example 12 illustrates alkyl(alkyl glycosid)uronamides ability to exhibit enhanced detergency and oily soil removal.

EXAMPLE 8

Krafft Point (Water solubility)

The Krafft point is defined as the temperature in which a surfactant becomes soluble in water and forms micelles instead of precipitates. The preferred interfacial phenomena is micellization, since the solubilization of soils or detergency by surfactants in compositions depend on the formation of these aggregates in solution. In general, surfactants with low Krafft point values are preferred, but not always necessary because compositions which contain highly soluble surfactants often dissolve other surfactants that are less soluble. Specifically, compounds most effective in enhancing foam and viscosity tend to be slightly soluble polar materials containing an amide linkage and a straight chain hydrocarbon group of approximately the same length as the hydrophobic group of the main surfactant. Surprisingly, we have found that alkyl(alkyl glycosid)uronamides which have extremely high Kraft point values and are completely insoluble in water can be solubilized by addition of small amounts of sodium dodecyl sulfate, a common anionic surfactant.

In order to demonstrate the new and unexpected result provided by the invention, the Kraft point of dodecyl(methyl β-D-glucofuranosid)uronamide (DoMβGlucf) amide was determined in the presence of an anionic surfactant, sodium dodecylsulfate (SDS). Solutions of 0.1% concentration by weight were prepared using a ratio of uronamide:SDS of 100:0, 90:10, 75:25, 50:50, 25:75, 10:90 and 0:100. Each mixture was heated using an oil bath until homogenous and then slowly cooled with stirring. The Kraft point was taken at the temperature at which haziness or precipitation occurred. The Krafft point of various uronamide/SDS mixtures are set forth below:

KRAFFT POINT OF VARIOUS (DoMβGlucf)amide/SDS Mixed Systems (0.1%)

| Ratio of Uronamide:SDS | Temperature (°C.) |
|---|---|
| 100:0 | >100 (insoluble) |
| 90:10 | 40 |
| 75:25 | 31 |
| 50:50 | 29.5 |
| 25:75 | 29 |
| 10:90 | 7 |
| 0:100 | 2 |

As indicated by the above table, addition of a small amount of SDS (90:10) unexpectedly reduced the Krafft point of dodecyl(methyl β-D-glucofuranosid)uronamide (DoMβGlucf)amide significantly. This result suggests that alkyl(alkyl glycosid)uronamides may be used as a cosurfactant for liquid or powdered compositions, such as shampoos, conditioners, liquid hand soaps, light or heavy duty liquid detergents, powdered detergents, shower gels, bubble baths, lotions, mouthwash or dentifrice.

EXAMPLE 9

Foam Stability

The generation of a thick stable foam is important, because consumers are accustomed to, and expect, liquid compositions to produce a copious and rich foam. Composition that do not generate sufficient foam are often seen as inferior. Accordingly, we have found that the glycolipids of the invention, unexpectedly stabilize and enhance the foam of SDS, a commonly used anionic surfactant, very effectively.

In order to demonstrate the improved ability of alkyl(alkyl glycosid)uronamides to stabilize and enhance foam, 0.1% solutions of 90:10, 75:25, 1 50:50, 10:90 and 0:100 dodecyl(methyl β-D-glucofuranosid-)uronamide/SDS were tested according to the Ross-Miles foam height assay (ASTM D 1173-53; Oil & Soap (1958), 62:1260).

In the Ross-Miles method, 200 mL of a solution of surfactant contained in a pipette of specified dimensions with a 2.9-mm-i.d. orifice is allowed to fall 90 cm onto 50 mL of the same solution contained in a cylindrical vessel maintained at a given temperature by means of a water jacket. The height of the foam produced in the cylindrical vessel is read immediately after all the solution has run out of the pipette and then again after a given amount of time.

Using this method, the foam production (initial foam height) and foam stability (final foam height after 10 minutes) were measured at 40° C. and 0 ppm (parts per million) hardness.

The results are set forth below:

ROSS-MILES FOAM HEIGHT ASSAY OF VARIOUS (DoMβGlucf)amide/SDS Mixed Systems (0.1%), 45°C.

| Ratio of Uronamide/ SDS | Initial Foam Height | Final Height after 10 Min. | Foam Loss |
|---|---|---|---|
| 90:10 | 197.7 | 160 | 19.1% |
| 75:25 | 209.2 | 207 | 1.1% |
| 50:50 | 196.8 | 186.3 | 5.3% |
| 10:90 | 182.3 | 180 | 1.3% |
| 0:100 (SDS) | 148.3 | 78.7 | 46.9% |

As indicated by the above table, dodecyl(methyl β-D-glucofuranosid) uronamide was found to enhance and stabilize the foam of sodium dodecyl sulfate (SDS). This enhancement was largest and most stable when the ratio of dodecyl(methyl β-D-glucofuranosid)uronamide to SDS was 75:25 (foam loss of only 1.1%). Further comparison also reveals that lesser amounts of dodecyl(methyl β-D-glucofuranosid)uronamide (10:90) also enhance and stabilize foam effectively (foam loss of only 1.3%).

To further demonstrate the ability of glycolipids of the invention to stabilize foam, a prototype shampoo composition comprising of dodecyl(methyl β-D-glucofuranosid)uronamide was tested according to the Ross-Miles foam height assay. The results were compared to identical compositions comprising of petrochemically derived thickening and foam stabilizing agents, in particular, alkanolamides or alcohol ethoxylates.

The prototype shampoo composition is as follows:

| INGREDIENTS | WT % | FUNCTION |
|---|---|---|
| Sodium Dodecyl Sulfate | 9.0 | Cleansing Agent |
| Ammonium Dodecyl Sulfate (30% Active) | 15.0 | Cleansing Agent |
| Dodecyl(Methyl β-D-Glucofuranosid) uronamide, Alkanoamide or Alcohol Ethoxylate | 4.0 | Foam stabilizer, viscosity modifier |
| Glycerine | 3.0 | Solubilizer |
| Sodium Chloride | 0.9 | Viscosity builder |
| Methyl Cellulose (25 cp at 2%) | 0.4 | Viscosity builder |
| Disodium EDTA | 0.1 | Sequestering Agent |
| Methylparaben | 0.1 | Preservative |
| Propylparaben | 0.01 | Preservative |
| Distilled Water | 67.49 | |
| TOTAL | 100.00 | |

The composition was prepared by admixing the ingredients in listed order with rapid stirring at 45°–50° C. until homogenous. Foam production and foam stability were measured at 0.1% based on SDS (0.16% solids) at 45° C. and 0 ppm hardness. The results are set forth below:

ROSS-MILES FOAM HEIGHT ASSAY OF SHAMPOO FORMULATION CONTAINING VARIOUS ADDITIVES, 0.1% SDS (0.16% solids), 45°C. 0 ppm HARDNESS

| FORMULATION | INITIAL FOAM HEIGHT | FINAL HEIGHT AFTER 60 MIN. |
|---|---|---|
| Formulation Plus (DoMβGlucf) amide | 190.3 | 150.8 |
| Formulation Plus Lauramide DEA | 189.7 | 151.3 |
| Formulation Plus Cocoamide MEA | 178.0 | 70.2 |
| Formulation Plus Neodol | 173.7 | 6.1 |

-continued

| ROSS-MILES FOAM HEIGHT ASSAY OF SHAMPOO FORMULATION CONTAINING VARIOUS ADDITIVES, 0.1% SDS (0.16% solids), 45°C. 0 ppm HARDNESS | | |
|---|---|---|
| FORMULATION | INITIAL FOAM HEIGHT | FINAL HEIGHT AFTER 60 MIN. |
| 91-6 Formulation Without Additive (Control) | 148.5 | 5.2 |

As indicated by the above table, dodecyl(methyl β-D-glucofuranosid) uronamide (DoMβGlucf) was found to enhance as well as stabilize the foam of a typical prototype shampoo formulation. This enhancement was comparable to that of lauramide DEA and better than cocoamide MEA or Neodol 91-6 ($C_9$ to $C_{11}$ alcohol ethoxylate with 6EO).

EXAMPLE 10

Viscosity Modification

It is well known that the viscosity of a liquid composition comprising of anionic surfactants can be modified by the addition of inorganic salts, such as sodium chloride. However, in the absence of an organic viscosity modifier, high levels of salt may be necessary to achieve the required viscosity which may lead to problems of storage at cold temperature or even salting out certain ingredients. In practice, however, the viscosity of a liquid composition is modified by the simultaneous addition of thickener and small amounts of inorganic salt (viscosity builder), the combined effect is greater than from either one alone.

In order to demonstrate the improved ability of alkyl(alkyl glycosid)uronamides to enhance viscosity, the viscosity of each shampoo composition in Example 9 was tested and measured. The results are set forth below:

| The Viscosity of a Prototype Shampoo Formulation Containing Various Additives at 22° C. | |
|---|---|
| 4% of Additive | Viscosity (Centipoise) |
| Dodecyl(Methyl β-D-Glucofuranosid)uronamide | 2685 |
| Lauramide DEA | 2376 |
| Cocoamide MEA | 1720 |
| Neodol 91-6 | 212 |
| No Additive | 22 |

As indicated by the above table, the addition of dodecyl(methyl β-D-glucofuranosid)uronamide to a shampoo composition increased the viscosity of that composition 122 times (2685/22=122) from its normal viscosity.

Also, closer comparison reveals that dodecyl(methyl β-D-glucofuranosid) uronamide unexpectedly enhances the viscosity of a shampoo composition more effectively than lauramide DEA and much more effectively than cocoamide MEA or Neodol 91-6.

EXAMPLE 11

Zein Solubilization Assay

The zein solubilization assay was developed to determine the biological effects of surfactants on the skin. This protein is normally insoluble in water, but can be brought into solution by interaction with surfactants. The extent of zein dissolved is related to the irritation potential of a surfactant. Thus, the greater the zein solubilization, the greater the irritation potential (M. J. Schwinger, Kolloid-Z.Z. Poly., (1969), 233, 848).

In order to demonstrate the improved ability of glycolipids to provide mildness benefits to the skin, a mixture of dodecyl(methyl β-D-glucofuranosid) uronamide and SDS were tested and compared to pure SDS. Thus, a 1% solution of surfactant (30 mls) was added to 1.5 g zein and stirred at room temperature for one hour. Residual zein was collected and dried to constant weight. Differences between starting and residual weights were used to calculate % zein solubilized. The results are set forth below:

| Active Ratio (DoMβGlucf) amide:SDS) | % Zein Solubilized |
|---|---|
| 0:100 | 83.7 |
| 25:75 | 59.0 |
| 33:67 | 50.7 |

As indicated by the above table, the addition of dodecyl(methyl β-D-glucofuranosid)uronamide to SDS (25:75 or 33:67) results in less zein solubilization. This finding suggests that the latter two formulations are more mild than SDS alone and so alkyl(alkyl glycosid-)uronamides not only enhance viscosity and stabilize foam, but reduce the irritation potential of SDS on the skin. The result suggests that alkyl(alkyl glycoid)uronamides may be useful as mild surfactant in cosmetic compositions.

EXAMPLE 12

Detergency Evaluation (Oily Soil Removal)

The detergency performance of tetradecyl(methyl β-D-glucofuranosid) uronamide was evaluated on a Lever Clay cloth (65/35 polyester/cotton cloth coated with ditallowdimethylamine cation/kaolinitic clay/-quartz mixture) and on a WFK 30D cloth (polyester cloth coated with pigment/sebum) using a tergotometer. The performance of tetradecyl(methyl β-D-glucofuranosid) uronamide was evaluated alone, in the presence of an anionic surfactant (linear alkylbenzenesulfonate) or in the presence of a mixture of anionic and nonionic surfactant (linear alkylbenzenesuifonate and Neodol 25-7) at about 0.22 g/L total suffactant. A nonphosphate, zeolite-built burkite powder was used as the base powder and dosed in about 0.75 g/L. The ratio of total surfactant to zeolite-buildt burkite powder was 21.6% to 78.4%. The system was kept at 37 or 40° C, 120 ppm hardness, pH=10 for 15 minutes. Detergency improvement was measured by a change in reflectance (ΔR) of the stained cloth, before and after washing with the powdered detergent prototype. In general, larger reflectance values suggest better detergency or improved oily soil removal.

The prototype powdered detergent composition is as follows:

| INGREDIENTS | WT % |
|---|---|
| Linear Alkylbenzenesulfonate (LAS) | 1–40 |
| Alkyl(Alkyl D-Dlycosid)Uronamide | 1–40 |
| Neodol 25-7 | 1–40 |
| Zeolite Burkite Base Powder | 30–97 |

Neodol 25-7 is an alkoxylated nonionic having an average degree of alkoxylation of about 7 and an average chain length of about $C_{12}$–$C_{15}$.

Detergency in Combination with Anionic Surfactant

The surfactant of the invention and LAS were used together for a total of 21.6% (by weight) in combination with 78.4% zealite burkite base powder. The ratio of the 21.6% total active was varied and results are set forth below.

Specifically, the detergency performance of tetradecyl(methyl β-D-glucofuranosid)uronamide on Lever Clay cloth at 40° C. is set forth below:

| SURFACTANT RATIO LAS:URONAMIDE (21.6% BY WT. TOTAL ACTIVE) | ΔR* |
|---|---|
| 100:0 | 14.4 |
| 75:25 | 17.1 |
| 50:50 | 20.8 |
| 25:75 | 16.4 |
| 0:100 | 8.2 |

*ΔR is change in reflectance is the amount of light reflecting back from a test cloth as measured using a standard reflectometer.

As seen from the above table, the addition of uronamide to LAS (75:25, 50:50 and 25:75) unexpectedly results in synergistic enhanced detergency and soil removal when compared to either LAS (100:0) or uronamide (0: 100) alone.

Detergency in Combination with Anionic and Nonionic

The surfactant of the invention was used with a mixture of LAS and nonionic in a total of 21.6% by weight (70:30 ratio of LAS to nonionic) in combination with 78.4% by weight zeolite burkite base powder.

Specifically, the detergency performance of tetradecyl(methyl β-D-glucofuranosid)uronamide on WFK 30D cloth at 37° C. is set forth below:

| SURFACTANT RATIO LAS:NEODOL 25-7:URONAMIDE | ΔR |
|---|---|
| 100:0:0 | 11.8 |
| 70:30:0 | 11.5 |
| 70:22.5:7.5 | 16.7 |
| 70:15:15 | 14.8 |
| 70:7.5:22.5 | 15.1 |
| 75:0:30 | 7.2 |
| 0:0:0 | 1.3 |

As seen from the above table, the addition of uronamide to a mixture of LAS and about 5% to about 25% Neodo125-7 (70:22.5:7.5, 70:15:15 and 70:7.5:22.5) unexpectedly results in synergistic, enhanced oily soil removal compared to either a mixture of LAS and Neodo125-7 (70:30:0) or LAS alone (100:0:0). The detergency data, suggests that alkyl(alkyl D-glycosid)uronamides of the invention not only provide viscosity modification and foam enhancement, but also provide synergistic detergency when mixed with anionic surfactants or nonionic surfactants or both.

It should be understood that the specific forms of the invention herein illustrated and described are intended to be representative only. Changes including but not limited those suggested in this specification, may be made in the illustrated embodiments without departing from the clear teachings of the disclosure. Accordingly, reference should be made to the following appended claims in determining the full scope of the invention.

What is claimed is:

1. A surfactant composition comprising an alkyl(alkyl glycosid)uronamide wherein said alkyl(alkylglycosid-)uronamide is selected from the group consisting of:

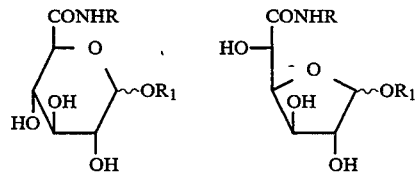

alkyl (alkyl D-glucosid) uronamides; and

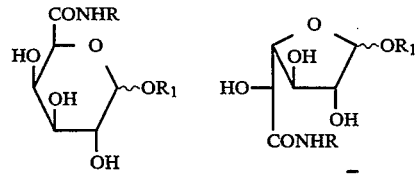

alkyl (alkyl D-galactosid) uronamides;

wherein:

$R_1$ is a saturated or unsaturated alkyl or alkenyl group having 1 to 8 carbons; and R is a saturated or unsaturated alkyl or alkenyl group having 6 to 24 carbons.

2. A composition according to claim 1, wherein $R_1$ has 1 to 3 carbons or is hydrogen and R has 8 to 18 carbons.

3. A composition according to claim 1 which is a liquid shampoo composition.

4. A composition according to claim 3 wherein the shampoo has the following ingredients:

| INGREDIENTS | WT % |
|---|---|
| Sodium Dodecyl Sulfate | 9.0 |
| Ammonium Dodecyl Sulfate (30% Active) | 15.0 |
| Dodecyl(Methyl β-D-Glucofuranosid)uronamide | 4.0 |
| Glycerine | 3.0 |
| Sodium Chloride | 0.9 |
| Methyl Cellulose (25 centipoise at 2%) | 0.4 |
| Disodium EDTA | 0.1 |
| Methylparaben | 0.1 |
| Propylparaben | 0.01 |
| Distilled Water | 67.49 |
| TOTAL | 100.00 |

5. A composition according to claim 1 which is a detergent composition.

6. A composition according to claim 5 which is a powdered composition and has the following ingredients:

| INGREDIENTS | WT. % |
|---|---|
| Linear Alkylbenzene Sulfonate (LAS) | 1–40 |
| Alkyl(alkyl D-glycosid)uronamide) | 1–40 |
| Neodol 5-7 | 1–40 |
| Zeolite Burkite Base Powder | 30–97 |

7. A composition according to claim 6 comprising about 20% by weight LAS and alkyl(alkyl D-glycosid-)uronamide and about 80% by weight burkite base powder.

8. A composition according to claim 7 wherein the ratio of LAS to uronamide is 75:25 to 25:75.

9. A composition according to claim 8 wherein the ratio of LAS to uronamide is about 50:50.

10. A composition according to claim 6 comprising about 20% by weight LAS, nonionic and alkyl(alkyl D-glycosid)uronamide and about 80% by weight Burkite base powder.

11. A composition according to claim 10, wherein the ratio of anionic to nonionic to uronamide varies from about 70:22.5:7.5 to 70:7.5:22.5.

* * * * *